US008333254B2

(12) United States Patent
Hall et al.

(10) Patent No.: US 8,333,254 B2
(45) Date of Patent: Dec. 18, 2012

(54) STEERING MECHANISM WITH A RING DISPOSED ABOUT AN OUTER DIAMETER OF A DRILL BIT AND METHOD FOR DRILLING

(76) Inventors: David R. Hall, Provo, UT (US); Jonathan Marshall, Provo, UT (US); Scott S. Dahlgren, Alpine, UT (US)

( * ) Notice: Subject to any disclaimer, the term of this patent is extended or adjusted under 35 U.S.C. 154(b) by 10 days.

(21) Appl. No.: 12/896,063

(22) Filed: Oct. 1, 2010

(65) Prior Publication Data

US 2012/0080233 A1 Apr. 5, 2012

(51) Int. Cl.
*E21B 7/04* (2006.01)

(52) U.S. Cl. ..... 175/61; 175/73

(58) Field of Classification Search ..... 175/258, 175/262, 352, 385, 73, 27, 57, 61, 62, 341, 175/342
See application file for complete search history.

(56) References Cited

U.S. PATENT DOCUMENTS

| | | | |
|---|---|---|---|
| 616,118 | A | 12/1889 | Kunhe |
| 485,103 | A | 12/1891 | Wegner |
| 946,060 | A | 1/1910 | Locker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,367,733 | A | 6/1921 | Midgett |
| 1,460,671 | A | 7/1923 | Hebsacker |
| 1,544,757 | A | 7/1925 | Hufford |
| 2,169,223 | A | 8/1931 | Christian |
| 1,821,474 | A | 9/1931 | Mercer |
| 1,879,177 | A | 9/1932 | Gautt |
| 2,054,255 | A | 9/1936 | Howard |
| 2,064,255 | A | 12/1936 | Garfield |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,776,819 | A | 1/1957 | Brown |
| 2,819,043 | A | 1/1958 | Henderson |
| 2,838,284 | A | 6/1958 | Austin |
| 2,755,071 | A | 7/1958 | Kammerer |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,294,186 | A | 12/1966 | Buell |
| 3,301,339 | A | 1/1967 | Pannebaker |
| 3,379,264 | A | 4/1968 | Cox |
| 3,429,390 | A | 2/1969 | Bennett |
| 3,493,155 | A | 2/1970 | Schonfield |
| 3,583,504 | A | 6/1971 | Aalund |
| 3,764,493 | A | 10/1973 | Rosar |
| 3,821,993 | A | 7/1974 | Kniff |
| 3,955,635 | A | 5/1976 | Skidmore |
| 3,960,223 | A | 6/1976 | Kleine |

(Continued)

*Primary Examiner* — Daniel P Stephenson
*Assistant Examiner* — James Sayre
(74) *Attorney, Agent, or Firm* — Philip W. Townsend, III

(57) ABSTRACT

In one aspect of the present invention, a steering assembly for downhole directional drilling comprises a drill bit comprising a cutting portion and an outer diameter. A steering ring disposed around the outer diameter, and at least one biasing mechanism disposed intermediate the outer diameter and the steering ring. The at least one biasing mechanism is configured to move the steering ring with respect to the outer diameter.

14 Claims, 9 Drawing Sheets

U.S. PATENT DOCUMENTS 4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,220,963 A * 6/1993 Patton ..... 175/24
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
6,929,076 B2 8/2005 Fanuel
6,953,096 B2 10/2005 Gledhill
2003/0213621 A1 11/2003 Britten
2004/0238221 A1 12/2004 Runia
2004/0256155 A1 12/2004 Kriesels
2007/0227775 A1* 10/2007 Ma et al. ..... 175/26
2008/0115974 A1* 5/2008 Johnson et al. ..... 175/61
2010/0006341 A1* 1/2010 Downton ..... 175/61
2010/0139980 A1* 6/2010 Neves et al. ..... 175/61

* cited by examiner

STEERING MECHANISM WITH A RING DISPOSED ABOUT AN OUTER DIAMETER OF A DRILL BIT AND METHOD FOR DRILLING

BACKGROUND OF THE INVENTION

The present invention relates to the field of steering assemblies used for downhole directional drilling. The prior art discloses directional drilling drill bit assemblies.

U.S. Pat. No. 6,550,548 to Taylor, which is herein incorporated by reference for all that it contains, discloses a rotary steering apparatus including a drill string, a drill bit, a main body connected at one end to the drill string and at another end to the drill bit, a sleeve extending around the main body such that the main body is freely rotatable within the sleeve, and a locking member affixed to the main body and interactive with the sleeve. The sleeve has at least one protruding pad extending outwardly therefrom so as to bear against a well bore. The locking member serves to lock the sleeve relative to the main body such that the sleeve rotates correspondingly with a rotation of the main body. The locking member locks the sleeve onto the main body relative to an increased flow rate of fluid through the interior passageway of the main body. The locking member includes a flipper pivotally connected to the main body so as to extend into the longitudinal passageway and a spring resiliently connected to the flipper so as to urge the flipper into the interior passageway with a desired spring rate.

U.S. Pat. No. 5,941,323 to Warren, which is herein incorporated by reference for all that it contains, discloses a drilling tool for use with a drill string into which drilling fluid is pumped. The tool comprises: a non-rotating housing having stabilizer blades on its outer surface; a rotating mandrel, passing through the housing; extendible blade means for moving the housing relative to a borehole; and a cam mechanism that is carried by at least one of the mandrel and the housing, and that is operated by drill string rotation and the flow of drilling fluid for operating the extendible blade means to move the drill string and steer the drill bit attached hereto.

BRIEF SUMMARY OF THE INVENTION

In one aspect of the present invention, a steering assembly for downhole directional drilling comprises a drill bit with a cutting portion and an outer diameter. A steering ring is disposed around the outer diameter, and at least one biasing mechanism is disposed intermediate the outer diameter and the steering ring. The at least one biasing mechanism is configured to move the steering ring with respect to the outer diameter.

The biasing mechanism may comprise an expandable element. The expandable element may comprise a composite, rubber, metal, ceramic, and combinations thereof. In some embodiments, when in expandable element is contracted, it may comprise two opposing sides joined by a length with an arched shape.

The biasing mechanism may comprise a piston or a ball configured to push against the steering ring so to move the steering ring with respect to the outer diameter. At least three biasing mechanisms may be equally spaced around the outer diameter.

The steering ring may comprise one continuous body. In some embodiments, the ring is rotationally fixed to the outer diameter. A plurality of cutting elements and/or junk slots may be disposed on the steering ring. A plurality of vanes may be disposed intermediate a plurality of biasing mechanisms and intermediate the steering ring and the outer diameter wherein the biasing mechanism may comprise a pressure region defined by the plurality of vanes.

A valve may be configured to control fluid pressure to the biasing mechanisms. The valve may be controlled by a telemetry system or an electronic circuitry system.

The drill bit may be an inner bit disposed in a bore of an outer bit. The steering ring may be disposed intermediate the outer bit and the inner bit. The steering ring may be configured to push against an inner diameter formed by the outer bit.

In another aspect of the present invention, a method of steering a drill string comprises the steps of: providing a drill bit comprising a cutting portion and an outer diameter, a steering ring disposed around the outer diameter, and a biasing mechanism disposed intermediate the outer diameter and the steering ring; deploying the drilling with in a wellbore; biasing the steering ring by the biasing mechanisms; and pushing off a surface by the steering ring.

The step of biasing may comprise applying fluid pressure on the biasing mechanism. The surface may be a surface of the wellbore or an inner diameter formed by an outer drill bit.

DETAILED DESCRIPTION OF THE INVENTION AND THE PREFERRED EMBODIMENT

Figure 1:
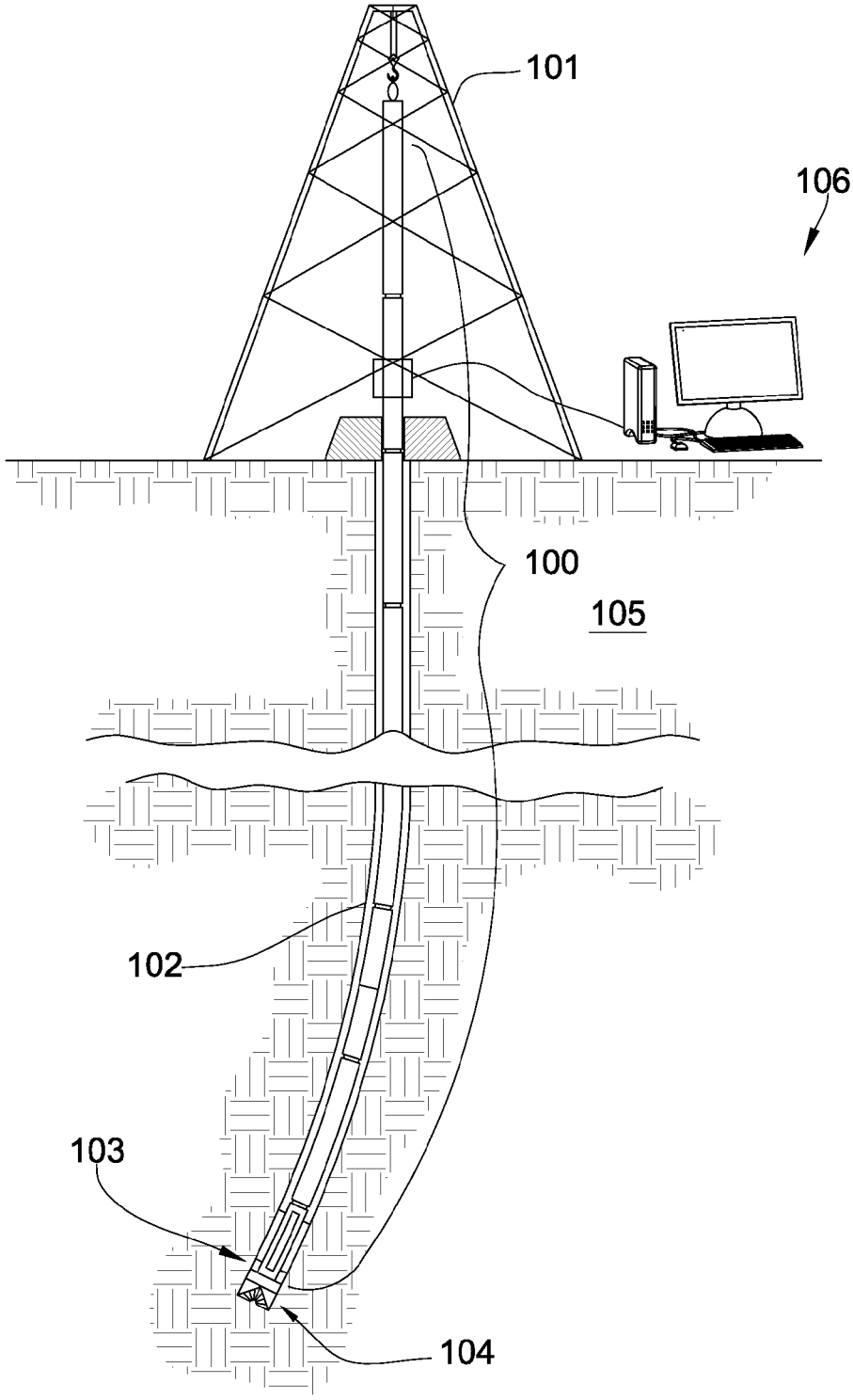
FIG. 1 is a perspective view of an embodiment of a drilling operation.

Referring now to the figures, FIG. 1 discloses a perspective view of an embodiment of a drilling operation comprising a downhole tool string 100 suspended by a derrick 101 in a wellbore 102. A steering assembly 103 may be located at the bottom of the borehole 102 and may comprise a drill bit 104. As the drill bit 104 rotates downhole, the downhole tool string 100 advances farther into the earth. The downhole tool string 100 may penetrate soft or hard subterranean formations 105. The steering assembly 103 may be adapted to steer the drill string 100 in a desired trajectory. The downhole tool string 100 may comprise electronic equipment able to send signals through a data communication system to a computer or data logging system 106 located at the surface.

Figure 2:
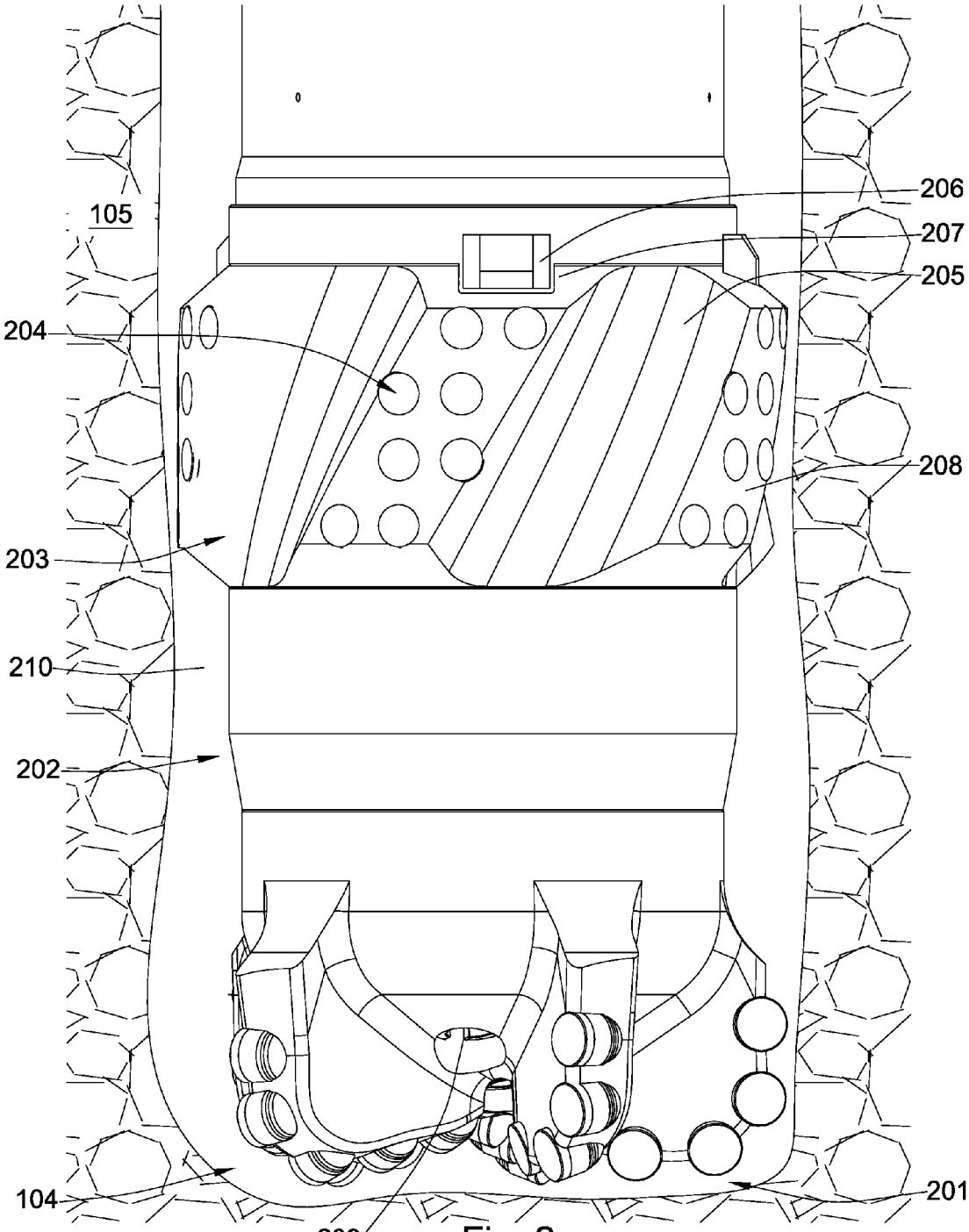
FIG. 2 is a perspective view of an embodiment of a drill bit.

FIG. 2 discloses a drill bit 104 comprising a cutting portion 201 and an outer diameter 202. The drill bit 104 comprises a plurality of blades converging at the center of the bit's face and diverging at an outer diameter of the bit 104. In some embodiments, the outer diameter 202 is a gauge portion of the bit 104. The blades may be equipped with cutters that degrade the formation 105. Fluid from drill bit nozzles 209 may remove formation fragments from the bottom of the wellbore and carry them up an annulus 210 of the wellbore.

A steering ring 203 may be disposed around the outer diameter 202, made of one continuous body. The steering ring 203 may also comprise a plurality of blades 208, cutting elements 204, wear blades, junk slots 205 and combinations thereof. During drilling operations, the ring's blades 208 may contact the formation 105. In some embodiments, the blades 208 may be stabilizer blades that center the drill bit 104. The ring's junk slots 205 may be configured to allow drilling mud and debris to pass by the steering ring 203 while the steering ring 203 is in substantial contract with the formation 105. The steering ring 203 may be rotationally fixed to the bit's outer diameter 202. The ring may be rotationally locked to the outer diameter 202 by interlocking a key 206 of the bit with a slot 207 of the steering ring 203 such that the steering ring 203 rotates at the same angular velocity as the drill bit 104. It is believed that rotationally fixing the steering ring 203 may be advantageous because it may be easier to identify the orientation of the outer diameter 202, and thus, the steering ring 203. If the steering ring 203 becomes stuck, then additional torque may be applied to the drill bit 104 to release the steering ring 203. Rotationally fixing the steering ring 203 is also believed to be advantageous because it may reduce friction between the steering ring 203 and outer diameter 202.

However, in some embodiments, the steering ring is not rotationally fixed to the outer diameter. The steering ring may be free-floating or driven at a higher or lower rotational velocity than the drill bit. In embodiments where the steering ring is configured to rotate at a differential speed than the outer diameter, the inner diameter of the steering ring may comprise a low friction surface to prevent wear. This may be accomplished through a coating, a plating, an electric depositation, a ground finish surface, or combinations thereof.

Figure 3:
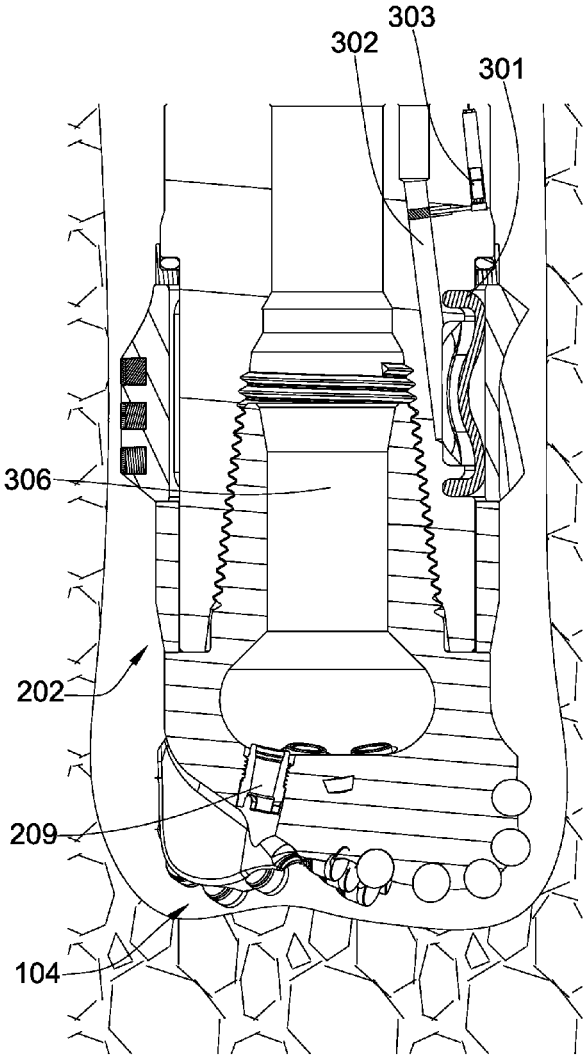
FIG. 3 is a cross-sectional view of another embodiment of a steering assembly.

FIG. 3 discloses a retracted biasing mechanism 301. The biasing mechanism 301 may comprise an expandable element. In some embodiments, the expandable element may be a billows, an inflatable bladder, a piston, a solenoid, a ball, or combinations thereof.

A valve 303 may be configured to control the amount of drilling fluid to flow through the fluid channel 302 and apply pressure to the biasing mechanism 301. The valve 303 may be controlled by a telemetry system or an electronic circuitry system. When the valve 303 is closed, fluid may be prevented from entering the channel 302 and the drilling fluid will remain in the drill string's bore 306 and flow out nozzles 209 of the drill bit 104.

In some embodiments, a plurality of biasing mechanisms 301 may be equally spaced around the outer diameter 202. When a straight trajectory is desired, the valves 303 distribute the drilling fluid such that a substantially equal amount of fluid flows through to each biasing mechanism 301. In some embodiments, the fluid channels 302 may be open to supply a constant flow of drilling fluid.

Figure 4:
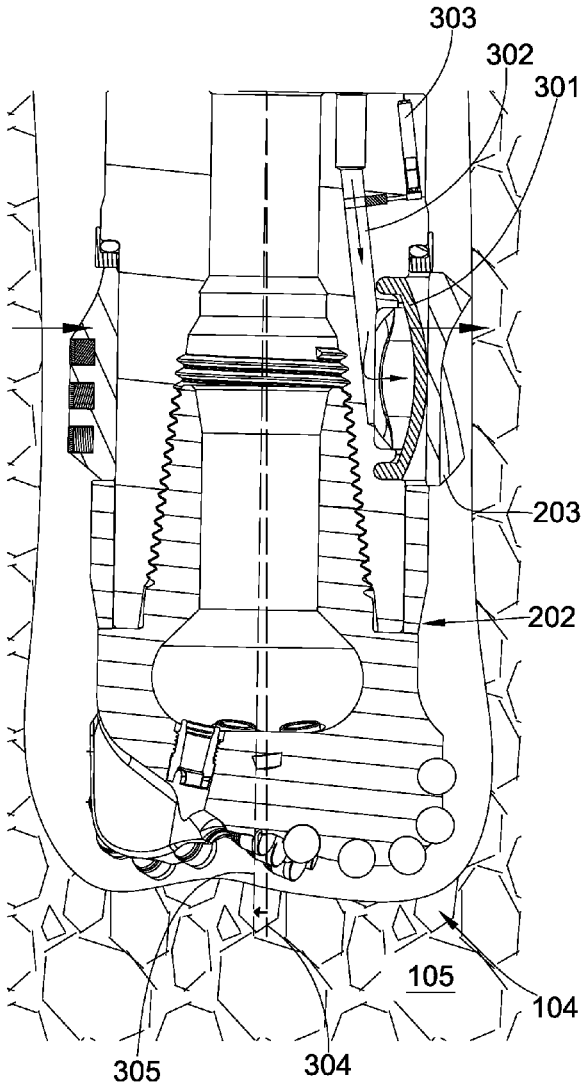
FIG. 4 is a cross-sectional view of another embodiment of a steering assembly.

FIG. 4 discloses a biasing mechanism 301 extended to push the steering ring 203. The drilling fluid flows through the fluid channel 302 and applies pressure to the biasing mechanism 301. As pressure is applied to the biasing mechanisms 301, they push the steering ring 203, which in turn pushes off of the formation 105 to steer the drill bit 104. As the steering ring 203 pushes off of the formation 105, the central axis of the drill bit 104 shifts from trajectory 304 to trajectory 305. In some embodiments, the valve 303 is configured to allow various amounts of fluid to the biasing mechanism 301. In situations where more fluid is allowed through, the biasing mechanism 301 may extend further, thus, steering the drill bit 104 at a steeper angle. In some embodiments, the valve 303 is merely an open/close valve.

The embodiment in FIG. 4 also discloses the steering ring 203 moving as a unitary unit when the biasing mechanism 301 moves the steering ring 203. The steering ring 203 may comprise a single, continuous body such that when the biasing mechanism 301 pushes against one side of the steering ring 203, the other side of the steering ring 203 may move closer to the outer diameter 202. Thus, as one expandable element is extended and/or inflated to push one side of the steering ring 203 in one direction, the other side of the steering ring 203 will also move in that direction. In some embodiments, this unitary movement is utilized to actively deflate or retract expandable elements when another expandable element is being activated.

Figure 5:
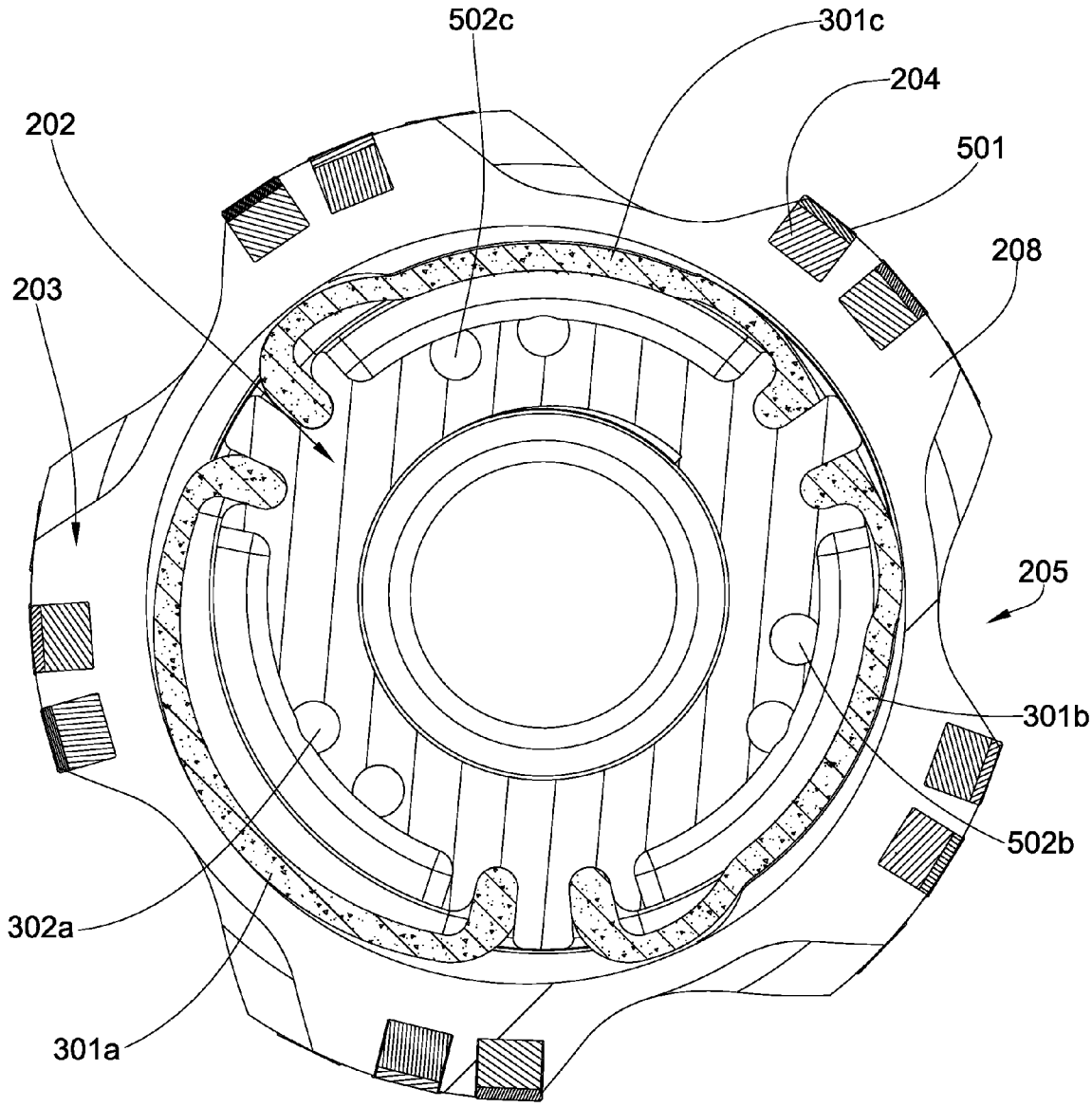
FIG. 5 is a cross-sectional view of another embodiment of a steering assembly.

FIG. 5 discloses the solid, continuous steering ring 203 surrounding the outer diameter 202. The steering ring 203 comprises a plurality of blades 208 and a plurality of junk slots 205. Three biasing mechanisms 301*a*, 301*b*, and 301*c* may be spaced equally around the outer diameter 202. Each of the biasing mechanisms 301*a*, 301*b*, and 301*c* may comprise a composite, rubber, metal, ceramic, and/or combinations thereof. In some embodiments, the composite may comprise metal or ceramic pieces embedded into the rubber. In some embodiments, metal or ceramic may form a netting that is disposed within the rubber. The composite, ceramic, or metal materials may reduce the wear on biasing mechanisms 301*a*, 301*b*, and 301*c*.

This embodiment discloses biasing mechanism 301*a* in an expanded position. Fluid may flow through fluid channel 302*a* and apply pressure to biasing mechanism 301*a*. As pressure is applied to biasing mechanism 301*a*, biasing mechanism 301*a* pushes on the steering ring 203 such that the steering ring 203 moves with respect to the outer diameter 202. Because the steering ring 203 is one continuous body encircling the outer diameter 202, as the biasing mechanism 301*a* pushes on the steering ring 203, the opposite side of steering ring 203 may push on biasing mechanisms 301*b* and 301*c*. Biasing mechanisms 301*b* and 301*c* may, thus, contract. Any fluid applying pressure to biasing mechanisms 301*b* and 301*c* may flow through exhaust channels 502*b* and 502*c*, respectively, into the annulus of the borehole. The steering ring 203 may comprise a plurality of cutting elements 204, which may be enhanced with sintered polycrystalline ceramic material 501. The sintered polycrystalline ceramic material 501 may comprise polycrystalline diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, silicon carbide, metal catalyzed diamond, or combinations thereof.

Figure 6:
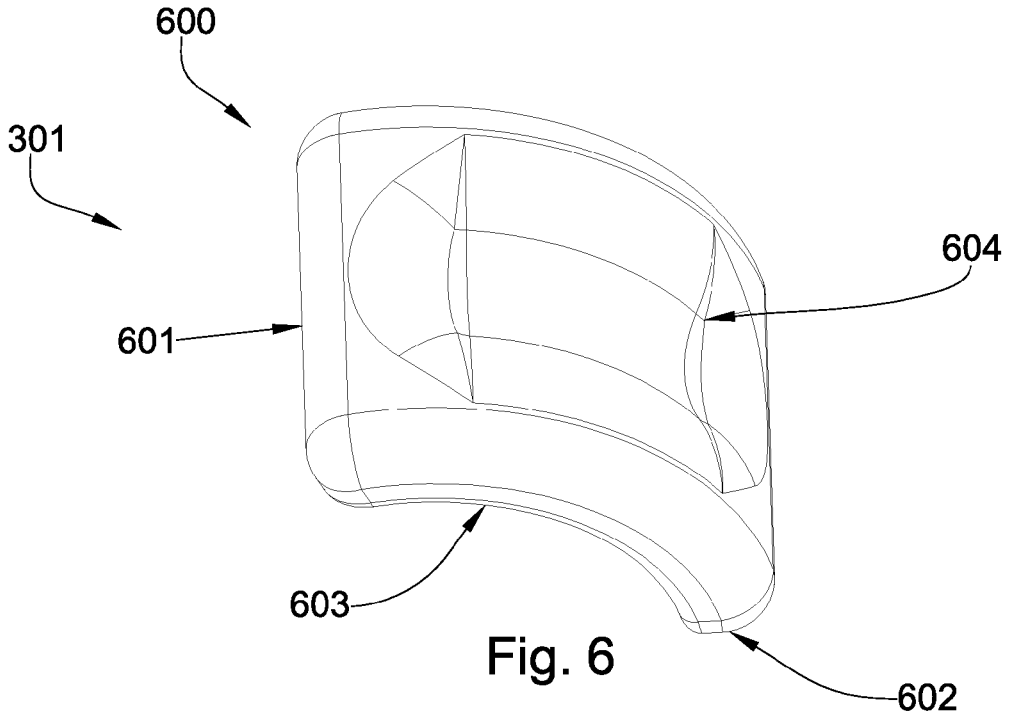
FIG. 6 is a perspective view of an embodiment of an expandable element.

FIG. 6 discloses a perspective view of an embodiment of a biasing mechanism 301. The biasing mechanism 301 may comprise an expandable element 600 configured to expand and contract. The expandable element 600, when contracted, may comprise two opposing sides 601 and 602 joined by a length 603. The length 603 may comprise an arched shape and may follow a curvature of the outer diameter. Depression 604 may be disposed on the expandable element 600, which may be configured to allow the expandable element 600 to expand. It is believed that this shape may increase the amount of surface area contacting the steering ring, which, may add to the stability of the steering ring.

Figure 7:
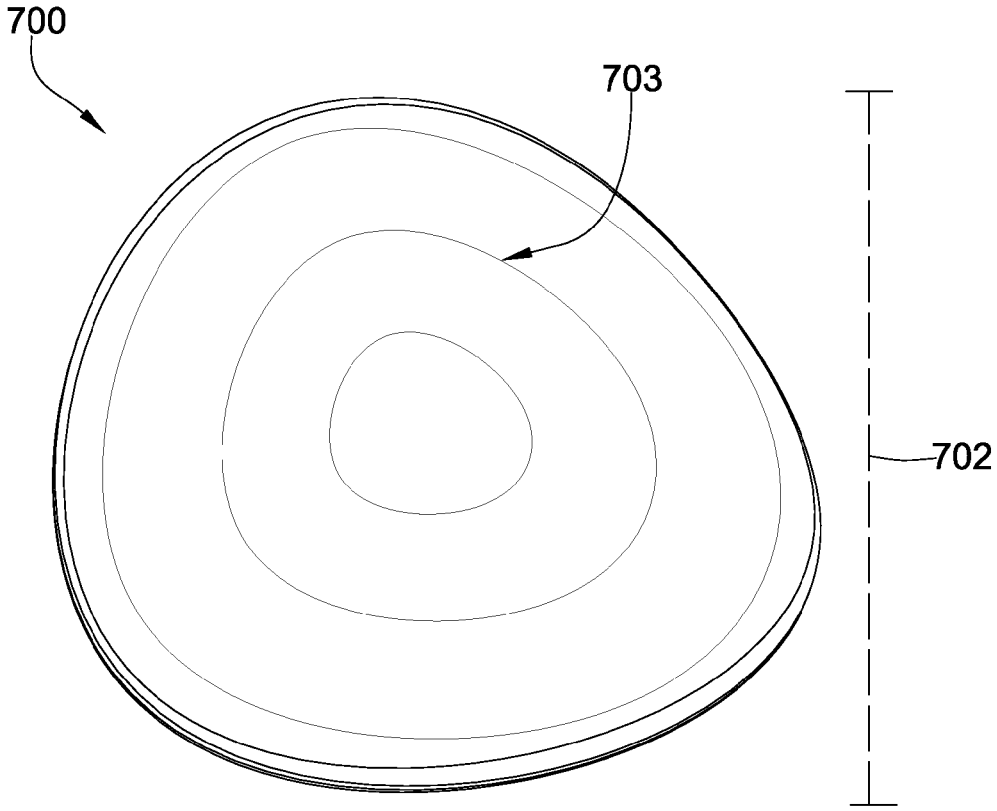
FIG. 7 is a perspective view of another embodiment of an expandable element.

FIG. 7 discloses a rounded expandable element 700 that comprises a diameter 702 comprising an arched shape that may follow a curvature of the outer diameter when contracted. A depression 703 on the expandable element 700 may allow the expandable element 700 to expand. This geometry may allow easy expansion and contraction.

Figure 8:
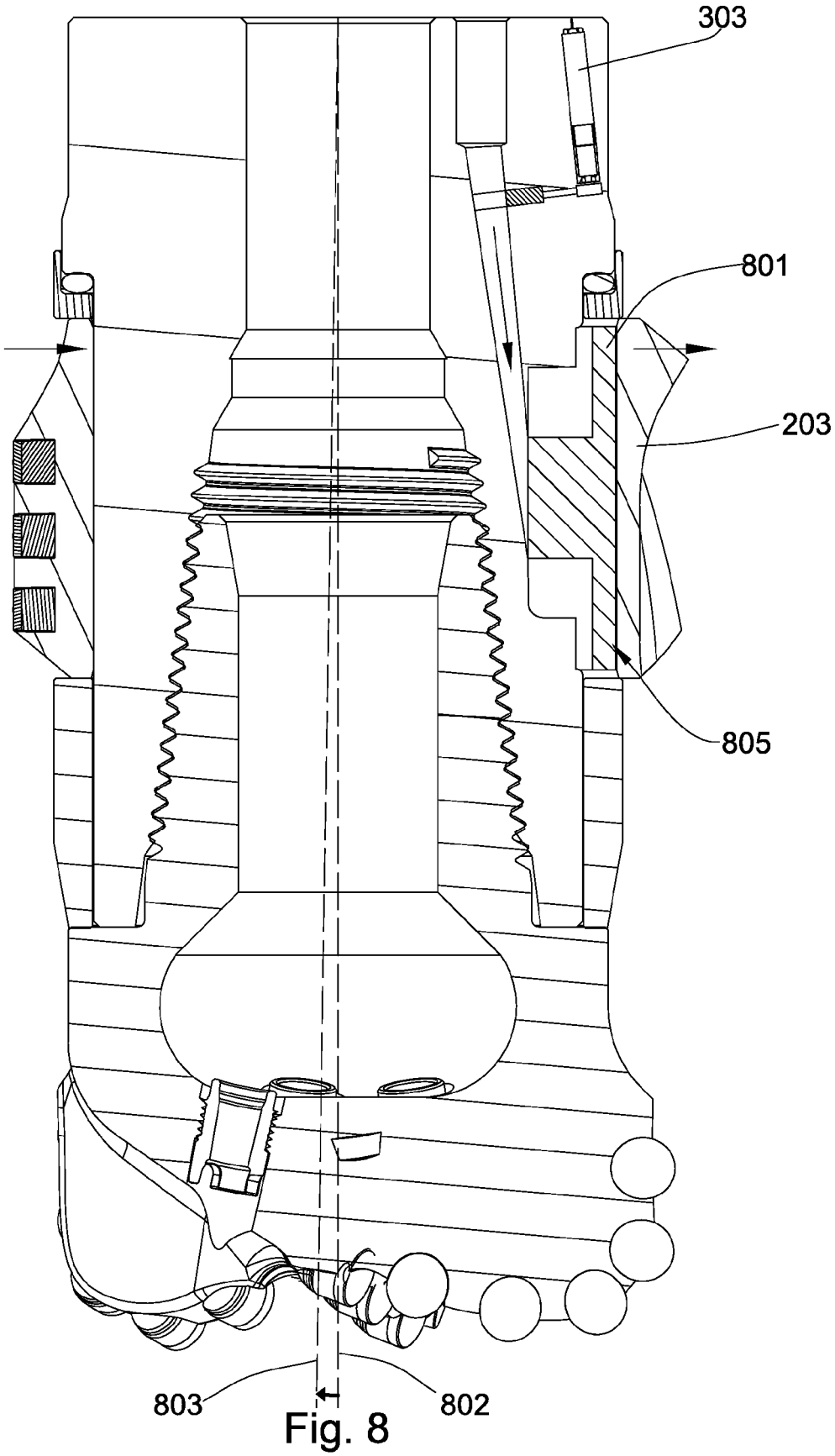
FIG. 8 is a cross-sectional view of another embodiment of a steering assembly.

FIG. 8 discloses a biasing mechanism 801 comprising a piston 805 configured to push against the steering ring 203. The valve 303 may control the amount of drilling fluid pressure that pushes against the steering ring 203. As the steering ring 203 pushes off of the formation, the central axis may shift from being aligned with trajectory 802 to trajectory 803. In some embodiments, a biasing mechanism may comprise a ball configured to push against the steering ring 203.

Figure 9:
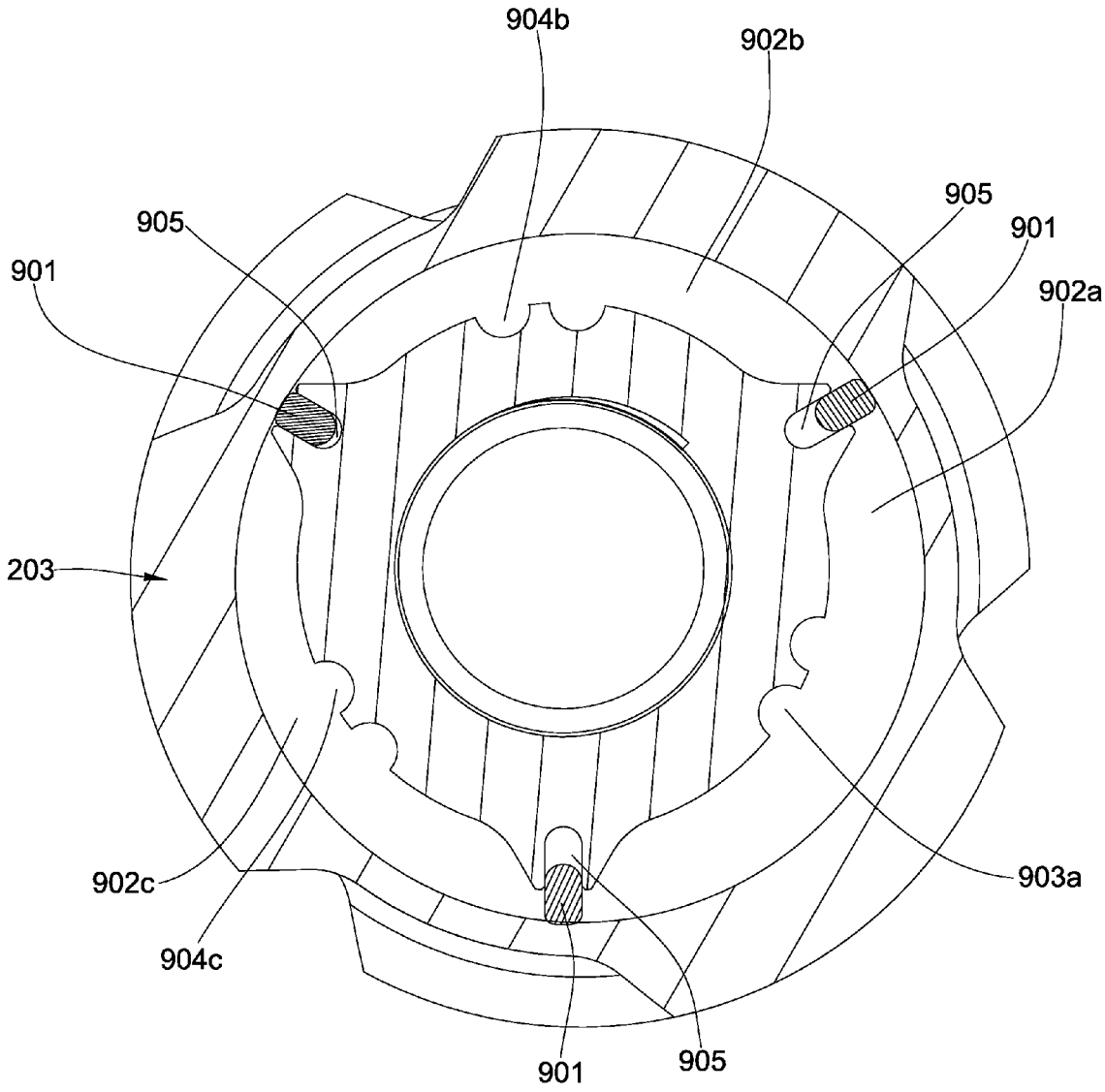
FIG. 9 is a cross-sectional view of another embodiment of a steering assembly.

FIG. 9 discloses pressure regions 902*a*, 902*b*, and 902*c* separated by the plurality of vanes 901. In this embodiment, fluid from fluid channel 903*a* pressurizes the pressure region 902*a* causing it to expand. During expansion, the steering ring 203 is moved against the formation to steer the drill bit. Also during expansion, the vanes 901 move radially, but stay within guided slots 905 to maintain a barrier between the pressure regions. After expansion, any remaining fluid in the pressure regions 902*b* and 902*c* may be vented out through exhaust channels 904*b* and 904*c*, respectively, en route to the annulus of the wellbore.

Figure 10:
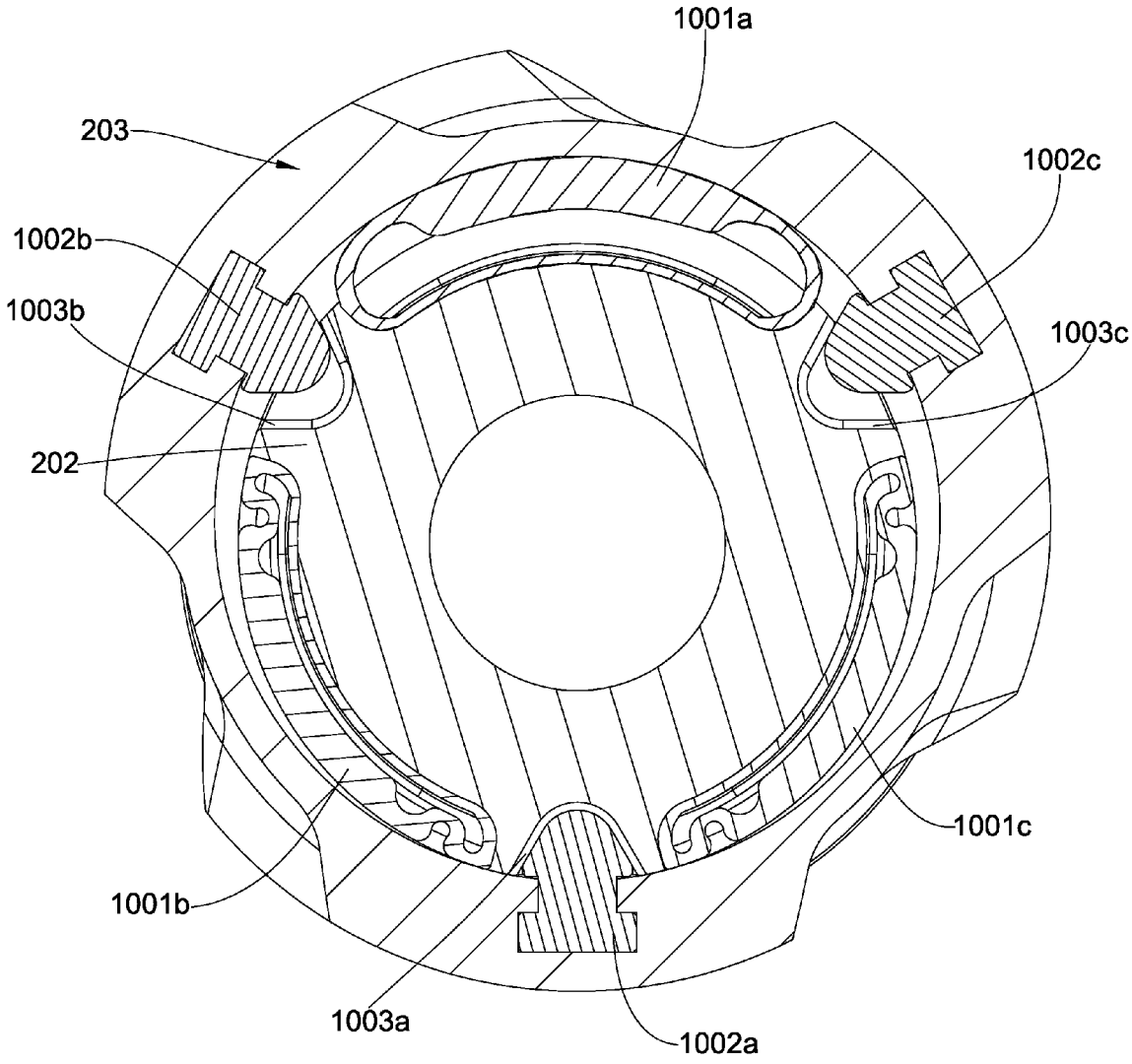
FIG. 10 is cross-sectional view of another embodiment of a steering assembly.

FIG. 10 discloses a steering ring 203 with protrusions 1002*a*, 1002*b*, and 1002*c*, which mate with recesses 1003*a*, 1003*b* and 1003*c*, respectively. These protrusions and recesses rotationally fix the steering ring 203 to the outer diameter 202. However, they also allow the steering ring 203 with an additional degree of freedom. In this embodiment, biasing mechanism 1001*a* is in an expanded position, which forces protrusion 1002*a* directly into recess 1003*a* and contracts biasing mechanisms 1001*b* and 1001*c*.

Figure 11:
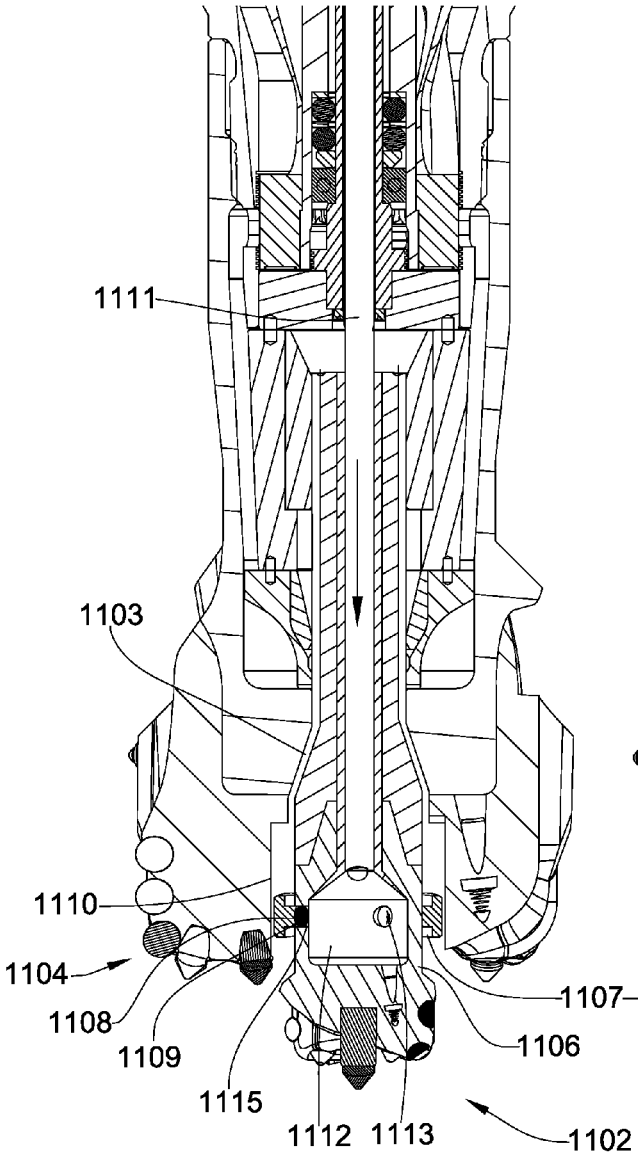
FIG. 11 is a cross-sectional view of another embodiment of a steering assembly.

FIG. 11 discloses an inner bit 1102 disposed in a bore 1103 of an outer bit 1104. The inner bit 1102 is connected to a downhole motor or turbine secured within a bore of the tool string by a drive shaft. The inner bit also has a steering ring 1107 disposed around the outer diameter 1106. In this embodiment, the biasing mechanism 1108 comprises a ball 1109 positioned in a channel 1115 formed in the body of the inner bit 1102. The ball 1109 is configured to push against the steering ring 1107, which will push off the inner diameter 1110 of the outer bit 1104.

The drive shaft may comprise a fluid passage 1111 that provides fluid to a fluid chamber 1112 within the inner bit 1102. Downhole circuitry, which may include a direction and inclination package, may rotate the orientation of the fluid chamber 1112. By rotating the fluid chamber 1112, chamber ports 1113 may align and misalign with the channels 1115 containing the balls 1109 for biasing the steering ring 1107.

Figure 12:
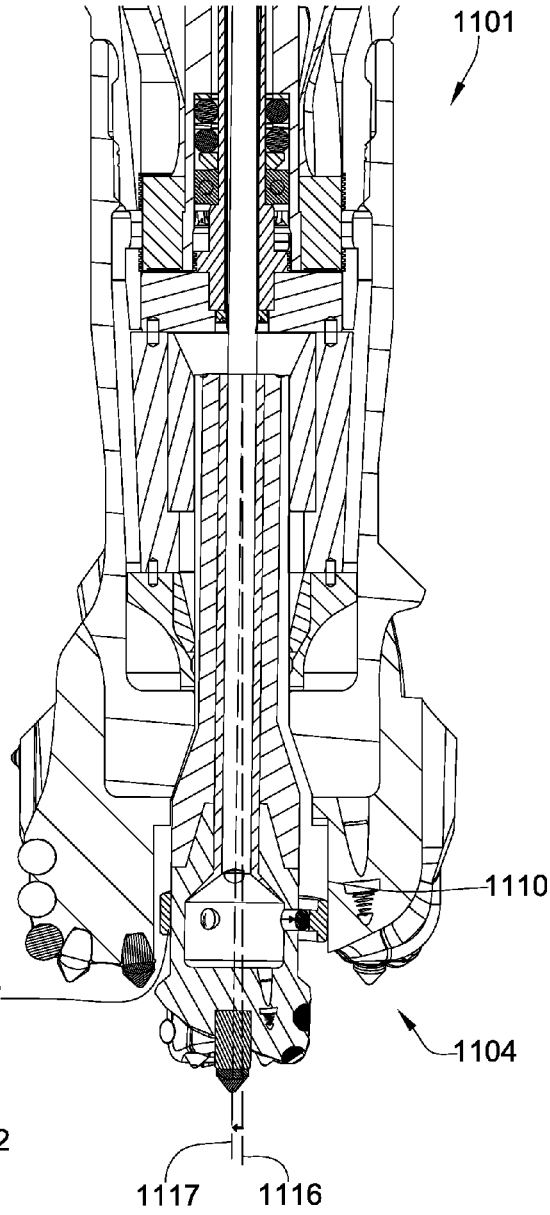
FIG. 12 is a cross-sectional view of another embodiment of a steering assembly.

FIG. 12 discloses the steering ring 1107 pushing off of the inner diameter 1110 of the outer bit 1104 and shifting the central axis of the drill bit 1101 from trajectory 1116 to trajectory 1117.

Whereas the present invention has been described in particular relation to the drawings attached hereto, it should be understood that other and further modifications apart from those shown or suggested herein, may be made within the scope and spirit of the present invention.

What is claimed is:

1. A steering assembly for downhole directional drilling, comprising:

a drill bit comprising a cutting portion and an outer diameter;

a steering ring disposed around the outer diameter and comprising one continuous body that is configured to rotate independent of the drill bit;

at least one biasing mechanism disposed intermediate the outer diameter and the steering ring and is configured to move the steering ring with respect to the outer diameter;

the at least one biasing mechanism comprising an expandable element that is configured to be expanded by drilling fluid;

the expandable element, when contracted, comprising two opposing sides joined by a length wherein the length comprises an arched shape that follows a curvature of the outer diameter;

the biasing mechanism comprising a valve that is configured to control an amount of drilling fluid that is diverted to push against the steering ring and move the steering ring with respect to the outer diameter; and the biasing mechanism comprising at least one exhaust channel configured to direct drilling fluid out of the biasing mechanism.

2. The assembly of claim 1, wherein the expandable element comprises a ceramic.

3. The assembly of claim 1, wherein at least three biasing mechanisms are equally spaced around the outer diameter.

4. The assembly of claim 1, wherein the steering ring comprises a plurality of cutting elements.

5. The assembly of claim 1, wherein the steering ring comprises a plurality of junk slots configured to allow drilling mud and degraded formation to pass by the steering ring.

6. The assembly of claim 1, further comprising a plurality of vanes disposed intermediate a plurality of biasing mechanisms and intermediate the steering ring and the outer diameter, wherein the at least one biasing mechanism comprises a pressure region defined by the plurality of vanes.

7. The assembly of claim 1, further comprising a valve configured to control fluid pressure to the at least one biasing mechanism.

8. The assembly of claim 7, wherein the valve is configured to prevent drilling fluid from entering the biasing mechanism when closed and force the drilling fluid to remain in a bore of the drilling assembly and flow out of nozzles in the drill bit.

9. The assembly of claim 1, wherein the drill bit is an inner bit disposed in a bore of an outer bit; the inner bit comprising a drive shaft with a rotatable, internal fluid chamber that aligns and misaligns ports of the chamber to direct fluid into the biasing mechanism.

10. The assembly of claim 9, wherein the steering ring is disposed intermediate the outer bit and the inner bit and is configured to push against an inner diameter formed by the outer bit.

11. A method of steering a downhole drill string, comprising:

providing a drill bit comprising a cutting portion and an outer diameter, a steering ring disposed around and encircling the outer diameter and comprising one continuous body that is configured to rotate independent of the drill bit, and at least one biasing mechanism disposed intermediate the outer diameter and the steering ring;

the at least one biasing mechanism comprising an expandable element that is configured to be expanded by drilling fluid;

the expandable element, when contracted, comprising two opposing sides joined by a length wherein the length comprises an arched shape that follows a curvature of the outer diameter;

deploying the drill string within a wellbore;

biasing the steering ring with the at least one biasing mechanism by applying pressure from a drilling fluid; and pushing off a surface by the steering ring.

12. The method of claim 11, wherein the step of pushing off includes pushing off a surface of the wellbore.

13. The method of claim 11, wherein the step of pushing off includes pushing off a surface of an inner diameter formed by an outer drill bit.

14. The method of claim 11, wherein the step of biasing includes applying pressure from drilling fluid of the drill string.

* * * * *